US008286350B2

(12) United States Patent
Takahashi et al.

(10) Patent No.: US 8,286,350 B2
(45) Date of Patent: Oct. 16, 2012

(54) METHOD OF MANUFACTURING A LIQUID DISCHARGE HEAD

(75) Inventors: Tsuyoshi Takahashi, Fukushima (JP); Shuji Koyama, Kawasaki (JP); Masaki Ohsumi, Yokosuka (JP); Masahisa Watanabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 346 days.

(21) Appl. No.: 12/699,995

(22) Filed: Feb. 4, 2010

(65) Prior Publication Data

US 2010/0212159 A1 Aug. 26, 2010

(30) Foreign Application Priority Data

Feb. 25, 2009 (JP) ..... 2009-042308

(51) Int. Cl.
*B21D 53/76* (2006.01)

(52) U.S. Cl. ..... 29/890.1; 29/611; 29/629; 29/831; 29/832; 29/852

(58) Field of Classification Search ..... 29/890.1, 29/611, 830, 831, 832, 612, 620, 852; 347/61, 347/62, 67, 20, 54, 56, 65; 216/27, 36, 41, 216/21

See application file for complete search history.

(56) References Cited

U.S. PATENT DOCUMENTS

| | | | | |
|---|---|---|---|---|
| 5,478,606 | A | 12/1995 | Ohkuma et al. | |
| 5,658,471 | A * | 8/1997 | Murthy et al. | 216/27 |
| 6,145,965 | A | 11/2000 | Inada et al. | |
| 6,186,616 | B1 * | 2/2001 | Inoue et al. | 347/45 |
| 6,390,606 | B1 | 5/2002 | Terui et al. | |
| 7,070,912 | B2 * | 7/2006 | Park et al. | 430/320 |
| 7,300,596 | B2 * | 11/2007 | Murayama et al. | 216/27 |

FOREIGN PATENT DOCUMENTS

| | | | |
|---|---|---|---|
| EP | 0 609 860 | B1 | 8/1994 |
| JP | 6-286149 | A | 10/1994 |
| JP | 9-01809 | A | 1/1997 |
| JP | 11-348290 | A | 12/1999 |

* cited by examiner

*Primary Examiner* — Derris Banks
*Assistant Examiner* — Tai Nguyen
(74) *Attorney, Agent, or Firm* — Fitzpatrick, Cella, Harper & Scinto

(57) ABSTRACT

An object of the invention is to provide a method of manufacturing a liquid discharge head in which a distance between a discharge opening and an energy generating element is uniform, simply and with good precision.

9 Claims, 4 Drawing Sheets

METHOD OF MANUFACTURING A LIQUID DISCHARGE HEAD

BACKGROUND OF THE INVENTION

1. Field of the Invention

The present invention relates to a liquid discharge head and a manufacturing method thereof, and more particularly, to an ink jet recording head and a manufacturing method thereof capable of performing recording by discharging ink onto a recording medium.

2. Description of the Related Art

As an application example of a liquid discharge head, there is an ink jet recording head for performing recording by discharging ink as liquid droplets onto a recording medium (generally, paper) by energy.

An example of a manufacturing method of such a liquid discharge head is disclosed in U.S. Pat. No. 7,070,912.

In the manufacturing method disclosed in U.S. Pat. No. 7,070,912, walls for a liquid flow path are provided on a substrate having energy generating elements for generating energy used to discharge liquid, an organic resin filler is placed in the flow path and on the walls of the flow path, and top surfaces of the filler and the walls of the flow path are flattened by polishing the top surfaces. Thereafter, a photosensitive resin layer is applied, and liquid discharge openings are provided in the layer.

Polishing of the organic resin filler may be performed using an apparatus for chemical mechanical polishing (hereinafter, called CMP), and the polishing is performed mainly with mechanical operations and, to a lesser extent, chemical operations.

However, there may be a case where a flat substrate surface is not achieved by the polishing. For example, since the hardnesses of the wall of the flow path and the filler are different from each other, their polishing speeds are different from each other, and uniformity of the organic resin film thickness in the silicon substrate surface cannot be sufficient. For example, in a case where a liquid discharge head is manufactured by cutting small chips from a disc-shaped wafer which is a silicon substrate, an outer peripheral portion of the disc-shaped wafer as the silicon substrate, which does not satisfy the small chip unit, is not provided with a flow path wall member. Then, the outer peripheral portion of the wafer is polished first, and there is a possibility that small chips may be obtained from the outer peripheral portion, the height of flow path wall will not be sufficiently uniform. Since the flatness of the photosensitive resin provided thereon is not sufficient, distances between the formed discharge openings and the energy generating elements are not uniform, and this may affect discharge characteristics.

SUMMARY OF THE INVENTION

In order to solve the problem, an object of the invention is to provide a method of manufacturing a liquid discharge head in which a distance between a discharge opening and an energy generating element is uniform, simply and with good precision.

According to an aspect of the invention, there is provided a manufacturing method of a liquid discharge head that includes a plurality of energy generating elements for generating energy to discharge liquid, a discharge opening member provided with liquid discharge openings, and a flow path that communicates with the discharge openings, the manufacturing method comprising: preparing a substrate having a head region in which a plurality of individual units, each of which is configured by a plurality of the energy generating elements which are arranged in rows and correspond to one liquid discharge head, are arranged adjacent to one another, and a peripheral region which is positioned on the outside of the head region and in which a number of the energy generating elements are arranged in rows to surround the head region, the number being less than the number of the energy generating elements in the individual unit; providing a solid layer on the head region and the peripheral region of the substrate; forming a plurality of side walls of the flow path corresponding to the individual unit on the head region, and forming an outer wall member provided to surround the plurality of side walls on the peripheral region, from the solid layer; providing a resin layer on a part that is to be the flow path so as to cover the side walls of the flow path and the outer wall member; polishing the resin layer toward the substrate so as to expose the side walls and the outer wall member from the surface of the resin layer; providing the discharge opening member so as to cover the resin layer and the side walls; forming the flow path by removing the resin layer; and removing the peripheral region from the substrate.

According to the invention, the liquid discharge head in which the distance between the discharge opening and the energy generating element is uniform can be obtained simply and with good precision.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

A manufacturing method of a liquid discharge head according to exemplary embodiments of the invention will now be described in detail in accordance with the accompanying drawings.

In addition, in this embodiment, a liquid supply port is formed by using anisotropic etching of silicon. However, dry etching may be used, and in this case, a sacrificial film is not needed.

Figure 4:
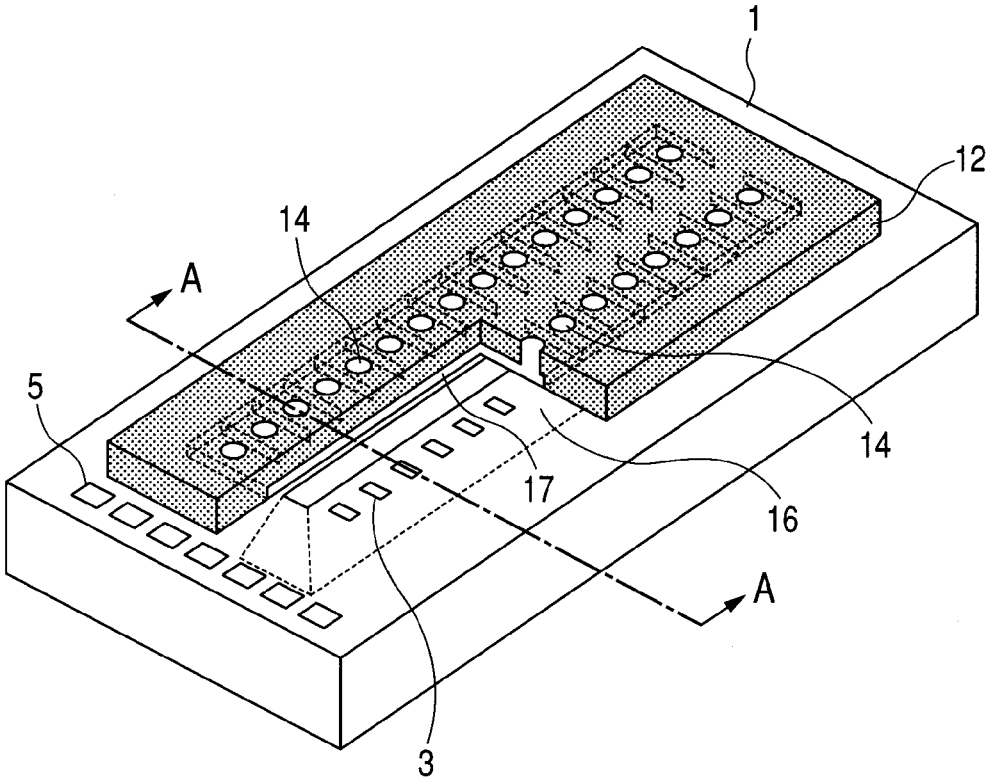
FIG. 4 is a schematic perspective view of a liquid discharge head.

FIG. 4 is a schematic perspective view of a liquid discharge head. The liquid discharge head is formed by arranging a plurality of discharge energy generating elements 3 in two rows at predetermined pitches on a substrate 1 made of silicon. A polyether amide layer (not illustrated) which is a contacting layer is formed on the substrate 1. In addition, on the substrate 1, a ceiling member provided with discharge openings 14 that open above the discharge energy generating elements 3 and flow path side walls 9 are formed of a cured photosensitive resin layer, so that a flow path 17 that communicates with each discharge opening 14 from the liquid supply port 16 is formed.

A pad 5 for supplying a signal to the discharge energy generating element 3 is provided on the substrate 1, and wiring (not illustrated) is connected to the discharge energy generating element 3 from the pad 5 to supply a signal.

The liquid supply port 16 formed by the anisotropic etching of silicon opens between the two rows of the discharge energy generating elements 3 such that the liquid supply port 16 is commonly used for the flow path provided for each discharge energy generating element 3.

The liquid discharge head performs recording by discharging liquid droplets from the discharge openings 14 adding pressure obtained from energy using the discharge energy generating elements 3 to liquid filled in the flow path 17 through the liquid supply port 16 so as to allow the liquid droplets to adhere onto a recording medium.

Figure 3:
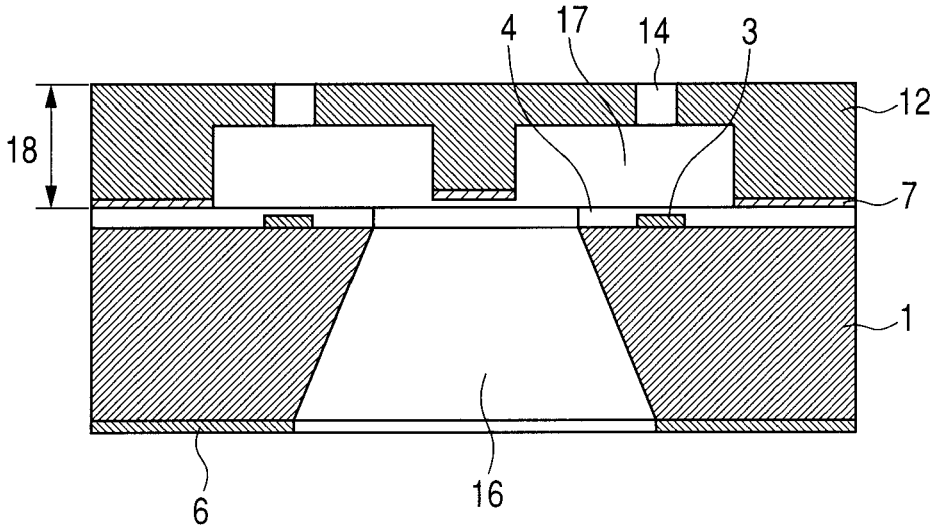
FIG. 3 is a schematic cross-sectional view illustrating a cross-section taken along the line A-A of FIG. 4.

FIG. 3 is a schematic cross-sectional view illustrating a cross-section taken along the line A-A of FIG. 4.

The discharge energy generating element 3 is provided on the surface of the substrate 1 made of silicon. The discharge energy generating element 3 is covered and protected by a protective film 4. The flow path side walls 9 are formed to cover the flow path 17 via the contacting layer 7 formed on the protective layer 4. The discharge opening 14 is provided in the flow path side wall 9 on an opposing side to the discharge energy generating element 3. The liquid supply port 16 that communicates with the flow path 17 is formed on the substrate 1. An OH distance 18 of the liquid discharge head is the distance from the energy generating surface of the energy generating element to the outer side of the discharge opening, and in this embodiment, the distance from the surface of the protective film 4 to the outer side of the discharge opening.

This liquid discharge head may be mounted in a printer, a copy machine, a facsimile having a communication system, an apparatus such as a word processor having a print unit, and a recording apparatus having various multiple processing devices. In addition, recording can be performed by the liquid discharge head onto a recording medium made of various types of material such as paper, yarn, fiber, leather, metal, plastic, glass, lumber, or ceramic. Furthermore, in the invention, "recording" means giving an image that does not have a meaning, such as a pattern, as well as an image that has a meaning, such as a text or figure, to a recording medium.

Example 1

Hereinafter, a manufacturing method of the liquid discharge head illustrated in FIG. 3 will be described with reference to the accompanying drawings. In this example, a multiple production method of forming chips each on which a liquid discharge head is formed together on the substrate 1 made of silicon to be adjacent to one another and cutting the chips from the substrate 1 thereby obtaining individual liquid discharge heads, is used.

Figure 5:
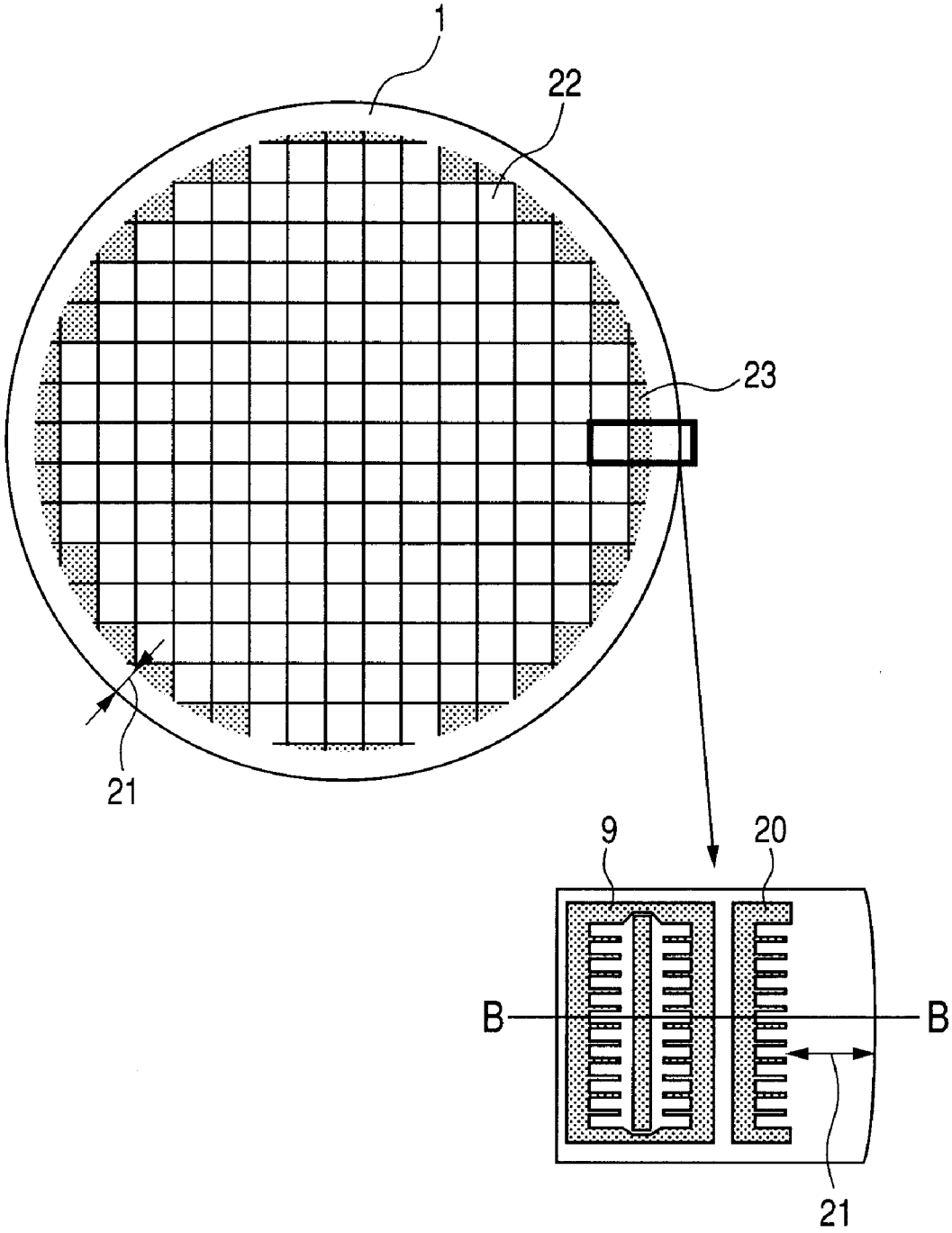
FIG. 5 is a schematic view illustrating how the chips are arranged on the substrate.

FIG. 5 is a schematic view illustrating how the chips are arranged on the substrate 1 made of silicon.

During exposure transportation, in order to prevent rubbish from generating due to contact between outer peripheries of substrates, a region (empty region) 21 in which a photoresist is not formed in an area of, for example, 3 mm from the outermost periphery of the substrate and the substrate surface (which is generally covered with the protective film) is exposed is provided. A region surrounded by the empty region 21 includes a chip region 22 in which chips each on which a liquid discharge head is formed are arranged and a region (peripheral region) 23 without chips, and the peripheral region 23 is provided adjacent to the empty region 21 and the chip region 22.

The peripheral region 23 is a region where a complete chip cannot be formed. Specifically, in the chip region, an energy generating element and an element film connected thereto, such as a wiring, are sufficiently formed in units of one chip. However, in the peripheral region, an element film that satisfies the one chip unit is not provided. In this example, a dummy pattern 20 as an outer wall member provided to surround the plurality of side walls for the flow path side wall 9 formed in units of chip is provided in the peripheral region 23.

As illustrated by a partial enlarged view of FIG. 5, in a process of forming the flow path side walls, as the dummy pattern 20 as an outer wall member provided to surround the plurality of side walls to be formed on the peripheral region 23, a part of the flow path side wall 9 is formed into the same shape as a part of a planar shape of the flow path side wall 9. The dummy pattern 20 is provided on a long side of the flow path side wall 9 in parallel with the long side of the flow path side wall 9.

It can be expected that a number of the discharge openings of the liquid discharge head are provided due to an increase in recording speed so as to lengthen the pattern of the flow path side wall 9. The dummy pattern 20 can be provided along the long side of the flow path side wall 9.

A reason why the empty region 21 where the photoresist is not formed is provided is to prevent rubbish from generating due to contact between outer peripheries of the substrates 1 during exposure transportation, and the empty region 21 can be formed by applying a photosensitive resin (photoresist) and removing the applied resin in advance by, for example, side rinsing using a spin coating apparatus.

Furthermore, even in a case where the empty region 21 is not provided, the peripheral region 23 on which a complete chip cannot be formed is provided on the outside of the chip region 22 while being adjacent to the chip region 22.

FIGS. 1A, 1B, 1C, 1D, 1E and 1F are schematic process cross-sectional views using a cross-section B-B of the outer peripheral portion of the silicon substrate illustrated in FIG. 5 and illustrates a basic manufacturing process of the liquid discharge head.

The substrate 1 made of silicon, in which crystal orientation of the substrate surface having the plurality of discharge energy generating elements 3 formed thereon is a 100 plane, is used. One side of the substrate 1 on which the discharge energy generating elements 3 are formed is referred to as a front (outer) surface, and the opposite side to the front surface is referred to as a rear surface.

The rear surface of the substrate 1 is covered with a silicon oxide film 6. A sacrificial film 2 is provided in a region of the substrate 1 where the liquid supply port 16 is to be formed, and the protective film 4 is formed to cover the sacrificial film 2 and the discharge energy generating elements 3. Since the sacrificial film 2 can be etched by an alkaline solution used for anisotropic etching of silicon that will be described later, the sacrificial film 2 can be made of polysilicon, aluminum with high etching speed, aluminum silicon, aluminum copper, or aluminum silicon copper. In this example, the sacrificial film 2 is formed of polysilicon using a CVD method and patterned by dry etching using a photoresist as a mask. The protective film 4 is a film for protecting the discharge energy generating element 3 from liquid such as ink and is a silicone insulating film such as a silicon nitride film, a silicon oxide film, or a silicon oxide nitride film. In this example, the silicon nitride film is formed by the CVD method (see FIG. 1A).

A polyether amide resin is applied to the entire front and rear surfaces of the substrate 1 and cured by baking. Next, a positive-type photoresist is applied (not illustrated) to the rear surface of the substrate 1 by spin coating. Thereafter, an etching mask is formed on the rear surface of the substrate 1 using a general photolithography method, and dry etching is used thereby forming a polyether amide resin pattern 8 (see FIG. 1B).

It is needless to say that the front (outer) surface of the substrate 1 may be protected when the polyether amide resin is patterned on the rear surface.

Next, a resin layer (not illustrated, and hereinafter, referred to as a solid layer) which is to be the flow path side wall is formed on the entire front surface of the substrate 1. As the solid layer, a negative-type photoresist is used.

Thereafter, the solid layer of the area of 3 mm from the outermost periphery of the substrate 1 is removed by side rinsing. Then, by using a general photolithography method, the flow path side wall 9 made of the cured solid layer is formed on the chip region 22, and the dummy pattern 20 made of the cured solid layer is formed on the peripheral region 23 (see FIG. 1C).

As a result, the empty region 21 where the protective film 4 is exposed is formed within 3 mm from the outermost periphery of the substrate 1, the flow path side wall 9 is formed in the chip region 22, and the dummy pattern 20 is formed in the peripheral region 23 between the empty region 21 and the chip region 22.

The dummy pattern 20 may be formed in the same pattern as the entire or a part of the planar shape of the flow path side wall 9. However, a dummy pattern (not illustrated) having a rectangular pattern may be formed along a line parallel to the flow path side wall 9. Since the flow path side wall 9 and the dummy pattern 20 are formed from the solid layer, their heights follow the thickness of the layer. After forming the flow path side wall 9, the contacting layer made of the polyether amide resin is patterned by dry etching using the flow path side walls 9 and the dummy pattern 20 as a mask.

Figure 1A:
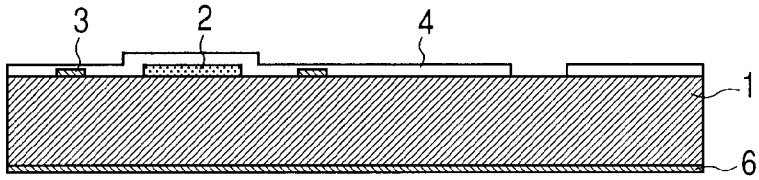
FIGS. 1A, 1B, 1C, 1D, 1E and 1F are schematic process cross-sectional views using a cross-section B-B of the outer peripheral portion of the silicon substrate illustrated in FIG. 5 and illustrate a basic manufacturing process of the liquid discharge head.
Figure 1B:
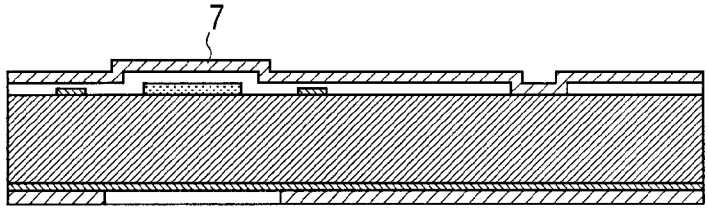
Figure 1C:
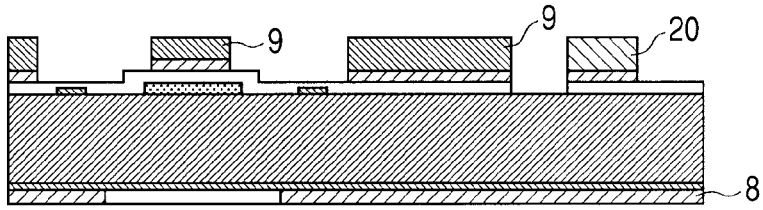
Figure 1D:
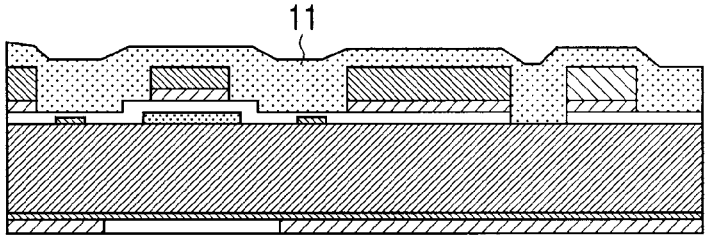

Next, in order to bury the flow path side wall 9 on the front surface side of the substrate 1, a burying material layer 11 made of a positive-type photoresist is stacked (see FIG. 1D).

Since the burying material layer 11 is eluted through the liquid supply port described later, a soluble resin layer may be used. Besides the positive-type photoresist, any material that is soluble through the liquid supply port may be used.

The thickness of the burying material layer 11 may be greater than the film thickness of the flow path side wall 9 in order to flatly polish the front surface made of the burying material layer 11 and the top surface of the flow path side wall 9 by polishing described later. As a result, a portion that is to be the flow path is buried by the burying material layer 11, and the flow path side wall 9 and the dummy pattern 20 are covered by the burying material layer 11.

Figure 1E:
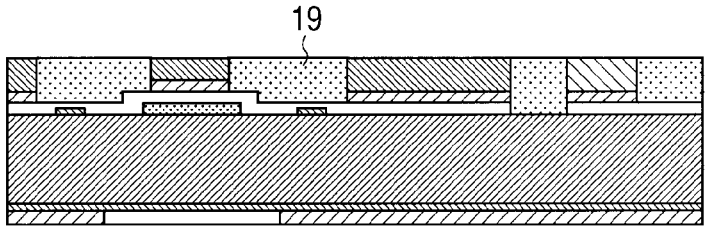

Next, a polishing process is performed by an apparatus for chemical mechanical polishing (CMP) to polish the solid layer until the top surface of the flow path side wall 9 is exposed from the top surface of the burying material layer 11, thereby forming a flat surface 19 (see FIG. 1E).

The flow path side wall 9 and the dummy pattern are the solid layers made of the negative-type photoresist cured by exposure, and the film hardness is higher than that of the soluble resin layer made of the positive-type photoresist. Accordingly, since the polishing speed of the soluble resin layer is higher than that of the negative-type photoresist which is cured by exposure to form the flow path side wall 9, when the surface of the solid layer is exposed from the soluble resin layer, polishing of the soluble resin layer is not performed.

Therefore, the thickness of the flat surface 19 from the substrate is substantially the same as the sum of film thicknesses of the positive-type resist that becomes the protective film 4, the contacting layer 7, and the flow path side wall 9.

In this example, unlike a related art, the dummy pattern 20 is formed adjacent to the outermost chip from among the chips that form the liquid discharge head, so that the thickness of the flat surface 19 from the substrate can be uniformized.

It is needless to say that tuning is performed under a suitable condition to prevent or suppress any scratches (minute cracks) or dishing (convex and concave) that occur when polishing is performed by the CMP apparatus. Due to the polishing process, the front surface of the substrate 1 becomes flattened, and the film thickness of the ceiling member can be uniformized when the ceiling member is formed in a process described later, so that the OH distance determined by the film thickness of the solid layer and that of the burying material layer can be precisely controlled.

The film thickness (OH distance) of the ceiling member may be equal to or higher than 25 μm and equal to or less than 80 μm.

Since the dummy pattern 20 is provided, controlling of flatness of the front surface becomes easy when the burying material layer 11 is polished, and the yield of the polishing process can be increased.

Next, on the surface subjected to the polishing process, a negative-type photoresist (not illustrated) that is to be the ceiling member is applied by spin coating to stack a resin layer. The negative-type photoresist is for forming a part of the ceiling of the flow path wall, and a material thereof may be selected for the purpose. The negative-type photoresist used for forming the flow path side wall may be used. Since the flatness of the surface applied with the negative-type photoresist is ensured by the polishing process, variation of the thickness over the entire resin layer can be effectively suppressed.

Thereafter, the negative-type photoresist of 3 mm is removed from the outermost periphery. Subsequently, the discharge opening 14 is formed by using a general photolithography method thereby completing the ceiling member 12 of the flow path side wall 9 (see FIG. 1F).

Figure 1F:
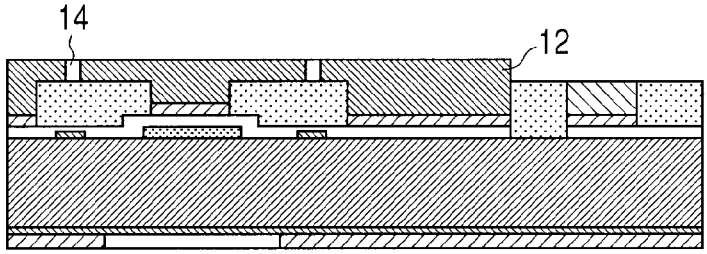

In addition, forming of the discharge opening 14 may be performed by the photolithography method using the same mask. FIG. 1F illustrates a condition in which the region where the dummy pattern 20 is formed is shielded.

Figure 2A:
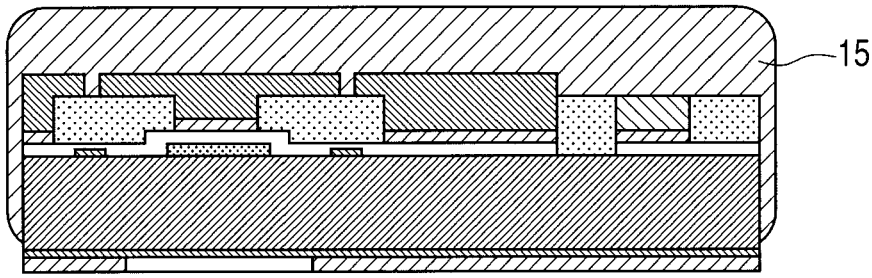
FIGS. 2A and 2B are schematic process cross-sectional views using a cross-section B-B of the outer peripheral portion of the silicon substrate illustrated in FIG. 5 and illustrate a basic manufacturing process of the liquid discharge head.

Next, a protective material 15 is formed by spin coating to cover the front surface and side surface of the substrate 1 (see FIG. 2A). The protective material 15 is a protective material for preventing cracks during transportation between apparatuses, and may be made of a material that sufficiently endures the strong alkaline solution used for anisotropic etching.

Figure 2B:
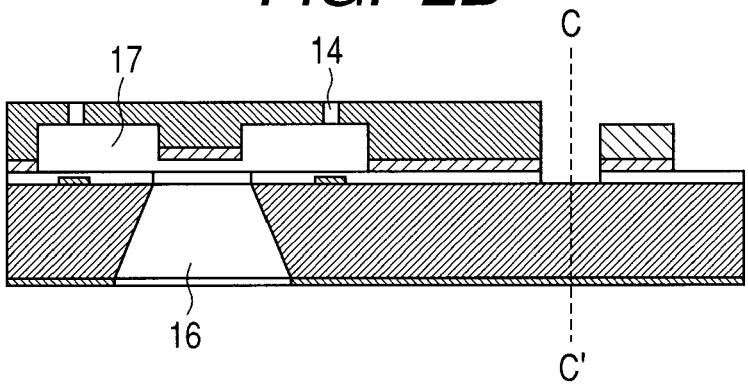

Next, the silicon oxide film 6 on the rear surface of the substrate 1 is patterned by wet etching using the polyether amid resin pattern 8 as a mask, so that a silicon surface that is a start surface of anisotropic etching is exposed. Thereafter, the substrate 1 is subjected to anisotropic etching using the strong alkaline solution such as TMAH, thereby forming the liquid supply port 16. Next, after removing the polyether amid resin pattern 8, the burying material layer 11 which is filled in the flow path side walls 9 is eluted from the liquid supply port 16, thereby forming the flow path 17 (see FIG. 2B).

The height of the flow path 17, that is, the film thickness of the flow path side wall 9 may be equal to or greater than 15 μm and equal to or smaller than 20 μm.

Before the burying material layer 11 made of the positive-type photoresist is removed, the burying material layer 11 is exposed (for example, irradiated with Deep UV light). Thereafter, the burying material layer 11 can be easily removed using a developer.

Last, the substrate 1 is separated by cutting using a dicing saw, and the chips are obtained, thereby completing the liquid discharge heads. When the liquid discharge heads are completed, the head is cut along a line C-C' shown in FIG. 2B, the peripheral region 23 is removed from the substrate 1 and the outer wall member 20 is separated from the wall of the flow path.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-042308, filed Feb. 25, 2009, which is hereby incorporated by reference herein in its entirety.

What is claimed is:

1. A manufacturing method of a liquid discharge head that includes a plurality of energy generating elements for generating energy to discharge liquid, a discharge opening member provided with liquid discharge openings, and a flow path that communicates with the discharge openings, the manufacturing method comprising the steps of:

preparing a substrate having a head region in which a plurality of individual units, each of which corresponds to one liquid discharge head, are arranged adjacent to one another, and a peripheral region which is positioned on the outside of the head region and in which a plurality of individual units, each of which does not correspond to one liquid discharge head, are arranged, each of the plurality of individual units in the head region comprising an element film with dimensions that satisfy dimensions of one liquid discharge head and each of the plurality of individual units in the peripheral region comprising the element film with dimensions that do not satisfy dimensions of one liquid discharge head;

providing a solid layer on the head region and the peripheral region of the substrate;

forming a plurality of side walls of the flow path corresponding to the individual unit on the head region, and forming an outer wall member provided to surround the plurality of side walls on the peripheral region, from the solid layer;

providing a resin layer on a part that is to be the flow path so as to cover the side walls of the flow path and the outer wall member;

polishing the resin layer toward the substrate so as to expose the side walls and the outer wall member from the surface of the resin layer;

providing the discharge opening member so as to cover the resin layer and the side walls;

forming the flow path by removing the resin layer; and removing the peripheral region from the substrate.

2. The manufacturing method according to claim 1, wherein the solid layer is a layer made of a negative-type photosensitive resin.

3. The manufacturing method according to claim 1, wherein the side wall and the outer wall member that oppose each other are substantially parallel to each other.

4. The manufacturing method according to claim 1, wherein the resin layer is a layer made of a positive-type photosensitive resin.

5. The manufacturing method according to claim 1, wherein the head region is a rectangular region.

6. The manufacturing method according to claim 1, wherein the peripheral region is removed from the substrate by cutting the substrate using dicing.

7. The manufacturing method according to claim 1, wherein a single liquid discharge head is obtained by segmenting the head region of the substrate.

8. The manufacturing method according to claim 1, wherein the peripheral region and a structure formed thereon are removed from the substrate.

9. The manufacturing method according to claim 1, wherein each of the plurality of individual units in the head region is provided with the plurality of energy generating elements in which the number of the plurality of energy generating elements corresponds to the number of the energy generating elements in one liquid discharge head, and wherein each of the plurality of individual units in the peripheral region is provided with the plurality of energy generating elements in which the number of the plurality of energy generating elements is less than the number of the energy generating elements in one liquid discharge head.

* * * * *